US007832471B2

(12) United States Patent
Verzwyvelt et al.

(10) Patent No.: US 7,832,471 B2
(45) Date of Patent: Nov. 16, 2010

(54) FITTING ARRANGEMENTS AND METHODS OF INSTALLING FITTING ARRANGEMENTS IN A WELL BORE

(75) Inventors: James Verzwyvelt, Lake Jackson, TX (US); James Hendricksonj, Sugar Land, TX (US); Ian Raw, Stavanger (NO); Michael Alff, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 412 days.

(21) Appl. No.: 12/057,741

(22) Filed: Mar. 28, 2008

(65) Prior Publication Data

US 2009/0243282 A1 Oct. 1, 2009

(51) Int. Cl.
*E21B 23/00* (2006.01)
*F16J 15/34* (2006.01)
*F16L 35/00* (2006.01)

(52) U.S. Cl. ..... 166/133; 166/188; 166/101; 277/376; 277/397; 285/39

(58) Field of Classification Search ..... 166/101, 166/378, 133, 188; 277/376, 397, 419, 547, 277/548, 603, 923, 925; 285/39
See application file for complete search history.

(56) References Cited

U.S. PATENT DOCUMENTS

| | | | | |
|---|---|---|---|---|
| 4,659,115 | A | 4/1987 | Cameron | |
| 4,936,618 | A | 6/1990 | Sampa et al. | |
| 6,609,567 | B2 * | 8/2003 | Ingram et al. | 166/126 |
| 6,702,015 | B2 * | 3/2004 | Fielder et al. | 166/133 |

FOREIGN PATENT DOCUMENTS

GB 2336170 B1 8/2002

* cited by examiner

*Primary Examiner*—Daniel P Stephenson
*Assistant Examiner*—Yong-Suk Ro
(74) *Attorney, Agent, or Firm*—Rodney V. Warfford; Kevin B. McGoff; Tim Curington

(57) ABSTRACT

A fitting arrangement and method of securing a fitting arrangement to a surface is provided. A plurality of adjacent fittings is coupled to and extends from a mounting surface of a structure in a well bore. Each fitting has an engagement surface that is configured to engage with an installation tool for coupling the fitting to the structure. The engagement surfaces of the adjacent fittings in the plurality are offset from each other to thereby define a clearance for the installation tool.

25 Claims, 6 Drawing Sheets

FITTING ARRANGEMENTS AND METHODS OF INSTALLING FITTING ARRANGEMENTS IN A WELL BORE

FIELD

The present application pertains to fitting arrangements and methods of installing fitting arrangements in a well bore. The examples provided herein are particularly useful for sealing control lines to a packer or other devices in a well installation. The examples also are useful wherever tight tolerances are present between adjacent fittings that are secured to a surface in a well bore by using, for example, an installation tool.

BACKGROUND

In the oilfield industry, it is desirable to run a plurality of control lines through downhole structures in a well bore. Control lines provide conduits for control equipment such as hydraulic lines, electrical lines, fiber optic cables, and the like. and are typically used to communicate in some manner with one or more tools placed in the well. For example, a packer placed downhole may be set by hydraulic fluid pressure communicated from the surface to an actuator mechanism of the packer. In addition, a fiber optic cable may be run through a control line and used, for example to measure the temperature profile of the well, or to communicate an operational command to a downhole tool.

Available tolerances and spaces between structures in downhole completions have decreased, in part because it has become necessary to run large numbers of control lines into wells and in a manner that bypasses various well devices, such as packers. Packers maintain contaminants in the casing string and prevent such contaminants from entering the reservoir surrounding the well. For this purpose, it is known to use a fitting to facilitate passage of the control line through the packer in a manner that also provides a fluid tight seal between the control line and the packer.

SUMMARY

As the number of control lines inserted into a well increases, smaller tolerances are created that make it more difficult to fit installation tools onto and between adjacent fittings. It has therefore become more difficult to assemble and disassemble fittings and control lines prior to and during well completion. The present application recognizes this problem and provides unique fitting arrangements and methods of installing fitting arrangements that overcome deficiencies in the art.

In one example, a plurality of adjacent fittings is coupled to and extends from a mounting surface of a structure in a well bore. Each fitting has an engagement surface that is configured to engage with an installation tool for coupling the fitting to the structure. The engagement surfaces of adjacent fittings in the plurality are offset from each other to thereby define a clearance for the installation tool.

Advantages and other features will become apparent from the following description, drawings, and claims.

BRIEF DESCRIPTION OF THE DRAWINGS

The best mode of carrying out the invention is described with reference to the examples illustrated in drawing FIGS. 1-8.

DETAILED DESCRIPTION OF THE DRAWINGS

Figure 7:
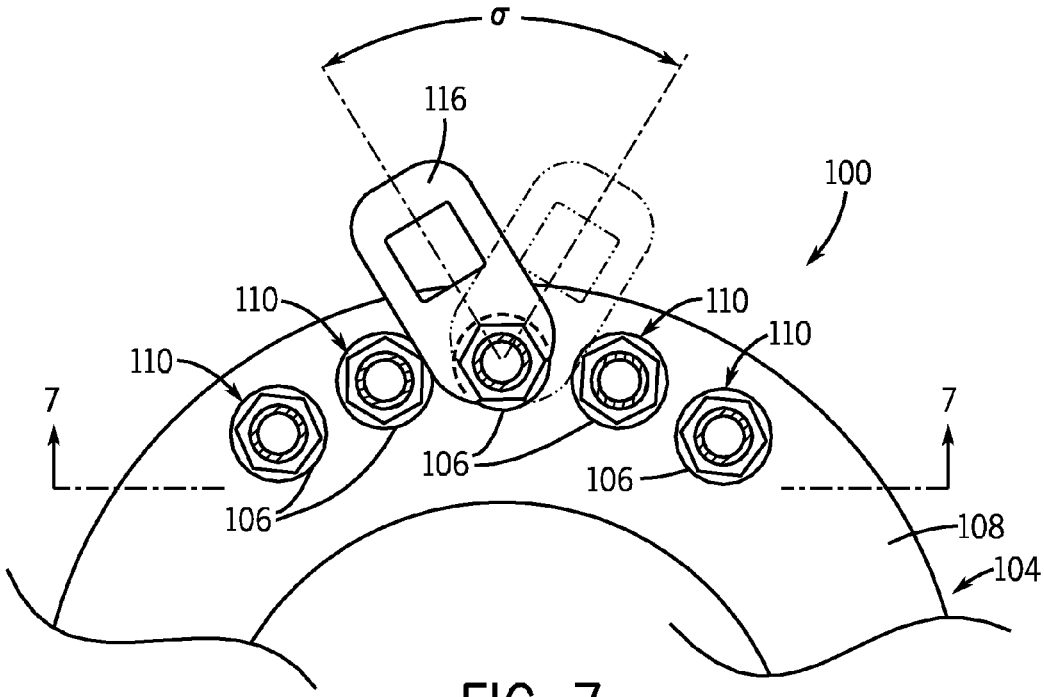
FIG. 7 PRIOR ART
FIG. 7 is a partial top view of a prior art fitting arrangement.
Figure 8:
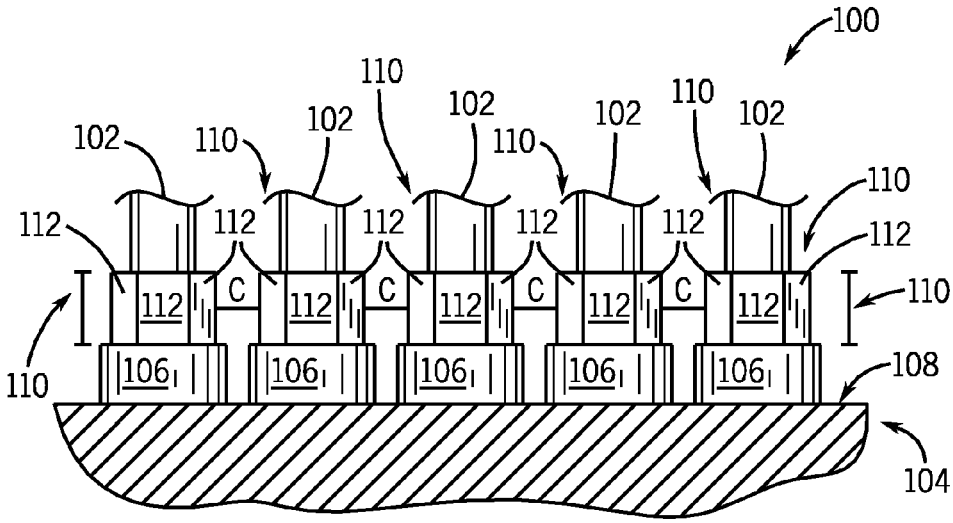
FIG. 8 PRIOR ART
FIG. 8 is a view of Section 7-7 taken in FIG. 7.

Referring briefly to FIGS. 7 and 8, a prior art fitting arrangement 100 is depicted that facilitates passage of control lines 102 into and through a packer 104. Fitting arrangement 100 including a plurality of aligned and adjacent fittings 106, each defining an inner passageway that is configured to receive and sealingly engage the outer circumference of a respective control line 102. Each fitting 106 extends axially outward from a mounting surface 108 on the packer 104 and has an engagement portion 110 that includes a series of six engagement surfaces 112 that extend 360 degrees around the outer circumference of the respective fitting 106. The respective engagement portions 110 of the fittings 106 are each located on the distal end of the respective fitting 106 and are aligned with each other in the axial direction and located adjacent to each other in a direction transverse to the axial direction. A conventional installation tool 116 is configured to engage two or more of the engagement surfaces 112. Rotation of the installation tool 116 in a clockwise or counter-clockwise direction causes rotation of the fitting 106 in the same direction and thereby, as known in the art, facilitates engagement or disengagement of the fitting 106 from the mounting surface 108.

At least one serious problem with the above-described prior art arrangement is hereby recognized. As more control lines are installed into the packer 104, the available clearance C in the transverse direction between each adjacent and axially aligned fitting 106 decreases, which leaves less room for connection and rotation of the installation tool 116. For example, the illustrated installation tool 116 is a wrench that is designed to engage at least four of the surfaces 112 on the fitting 106 in order to securely rotate the fitting 106 and secure it to the packer 104. The installation tool 116 must rotate through at least a 60 degree arc "θ" to facilitate reattachment of the tool 116 to at least one new engagement surface 112 on the fitting 106. The prior art fitting arrangement 100 thus disadvantageously requires a certain minimum clearance between adjacent fittings to facilitate attachment/detachment and rotation of the installation tool 110.

FIGS. 1-6 depict new fitting arrangements exemplifying the presently claimed invention. It should be noted that the invention described and depicted herein is susceptible to embodiments in many different forms. While this application contains drawings and description that refer to preferred embodiments, the application and drawings are not intended to limit the broad aspects claimed in the appended claims. For example, although the examples described herein refer to a fitting arrangement secured to a packer in a well installation, it should be recognized that the arrangements and methods described and set forth in the appended claims are adaptable for use in and with a variety of other well bore settings and structures. In addition the concepts set forth herein are not limited for use with the particular fitting arrangement shown and described, but rather are applicable with for example welded connections, hex bolts, screws, specialty fittings, etc.

Figure 1:
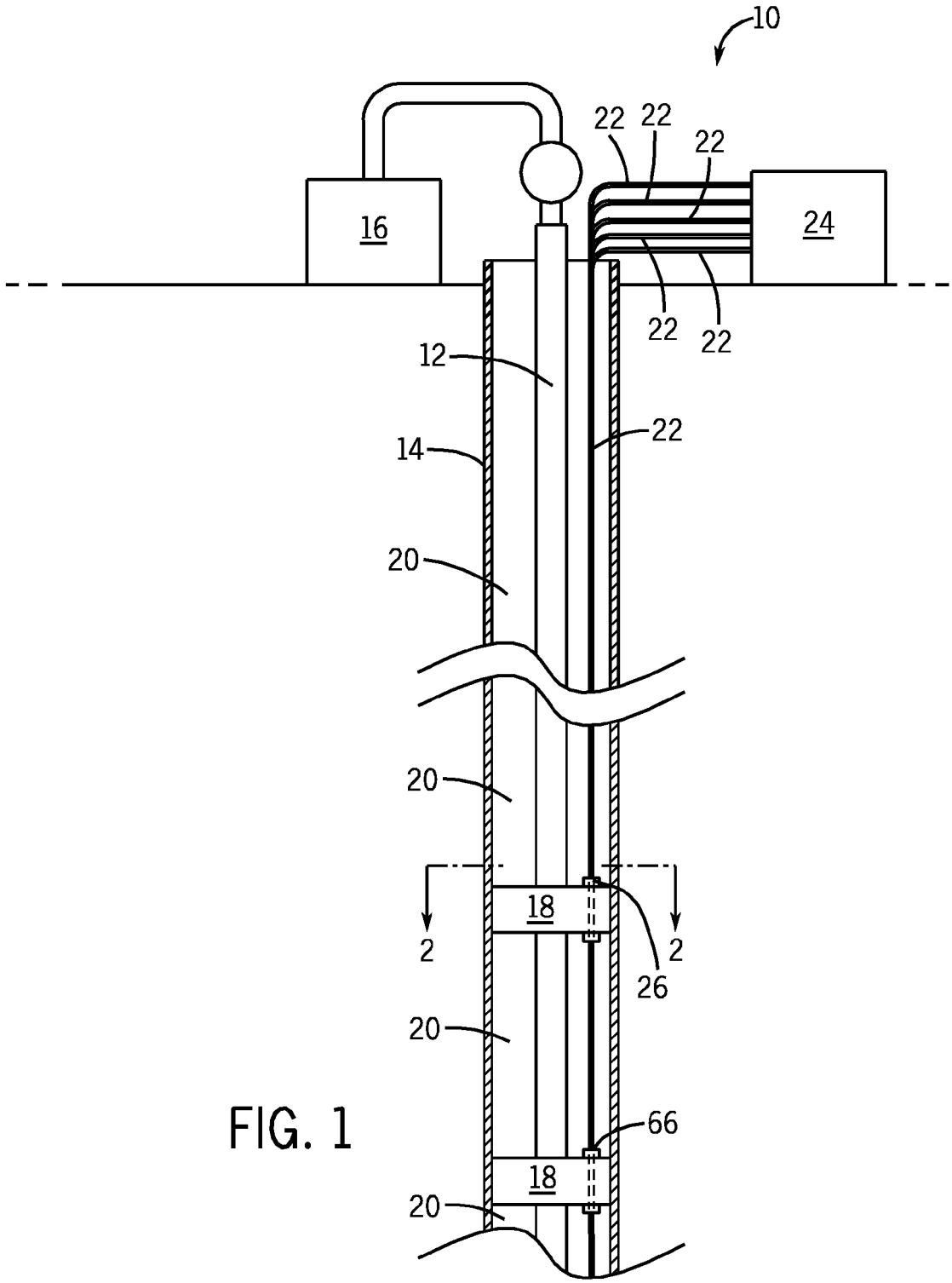
FIG. 1 is a schematic view illustrating fitting arrangements for securing control lines to packers in a well bore.

FIG. 1 depicts a well completion assembly 10. The assembly 10 includes a conventional tubing string 12 that is encircled by a casing 14. Conventional production equipment 16 is operatively connected to the upper end of the tubing string 12. A plurality of packers 18 are attached to the outer circumference of the tubing string 12. Each packer 18 creates a seal between the outer circumference of the tubing string 12 and the inner circumference of the well casing 14. Packers 18 therefore isolate completion zones 20 from one another and fill the gap between the tubing string 14 and well casing string 12 in such a way that fluids cannot move between the respective zones. Two or more control lines 22 extend down through the annular space between the tubing string 12 and casing string 14. The control lines 22 are attached to and extend from conventional control equipment 24. In the illustrated embodiment the control lines 22 are hydraulic control lines; however control lines 22 can also or alternatively comprise one or more electrical line conduits, fiber optic cables, and the like. Each control line 22 extends into and through the packers 18 via a fitting arrangement, examples of which will be described further hereinbelow.

FIGS. 2-5 depict a fitting arrangement 26 that facilitates passage of control lines 22 into and through each packer 18. Fitting arrangement 26 includes a plurality of aligned and adjacent fittings 28*a*-28*e*, each defining an inner passageway 30 that is configured to receive and sealingly engage the outer circumference of a respective control line 22. Each fitting 28*a*-28*e* extends axially outward from a mounting surface 31 on the packer 18 and has an engagement portion 32. The engagement portion 32 has a height in the axial direction that is designated in FIG. 3 by bracket 32. The engagement portion includes six engagement surfaces 34, aligned in series and extending 360 degrees around the outer circumference of the respective fitting 28*a*-28*e*.

Figure 2:
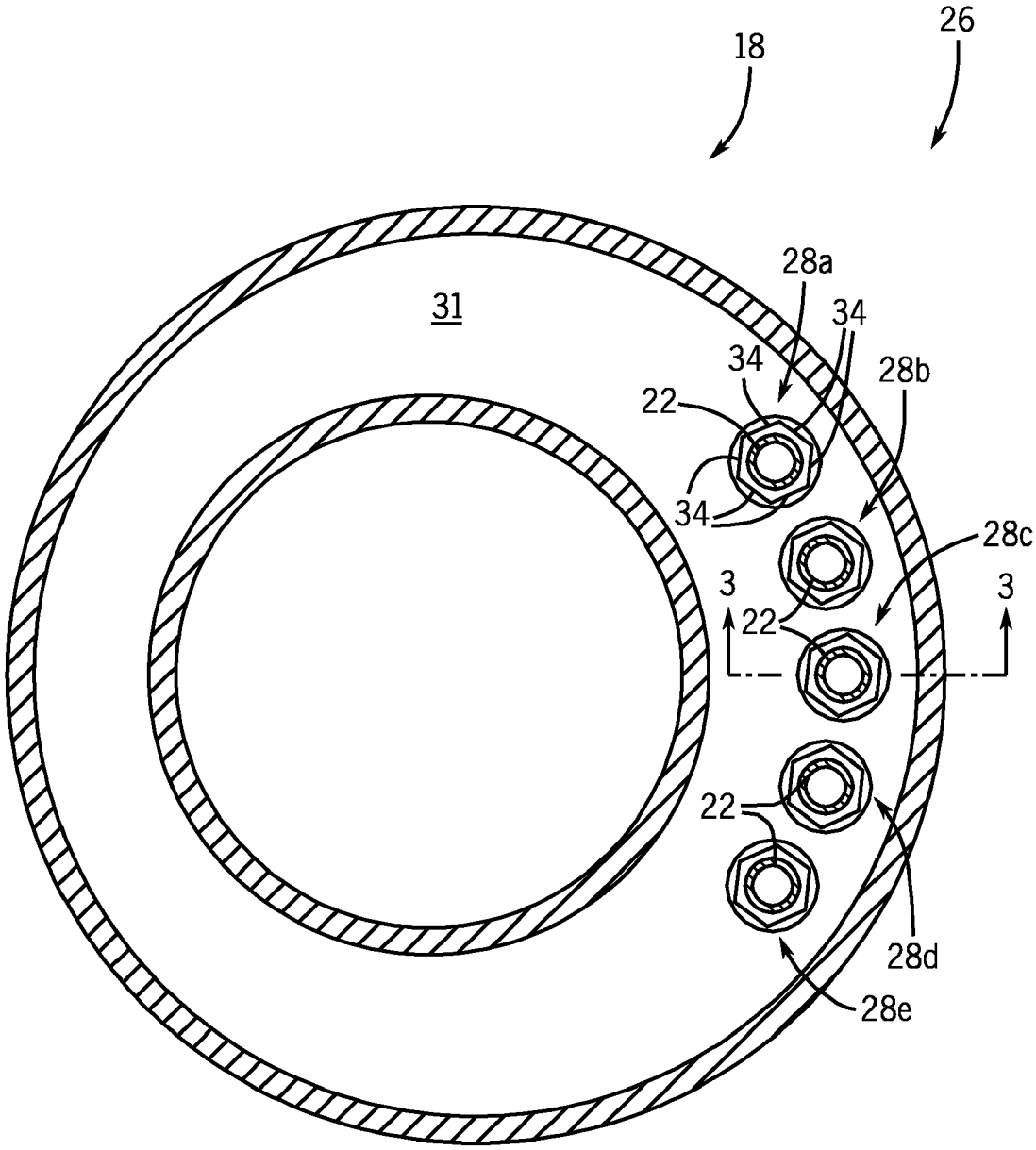
FIG. 2 is a view of Section 2-2 taken in FIG. 1.
Figure 3:
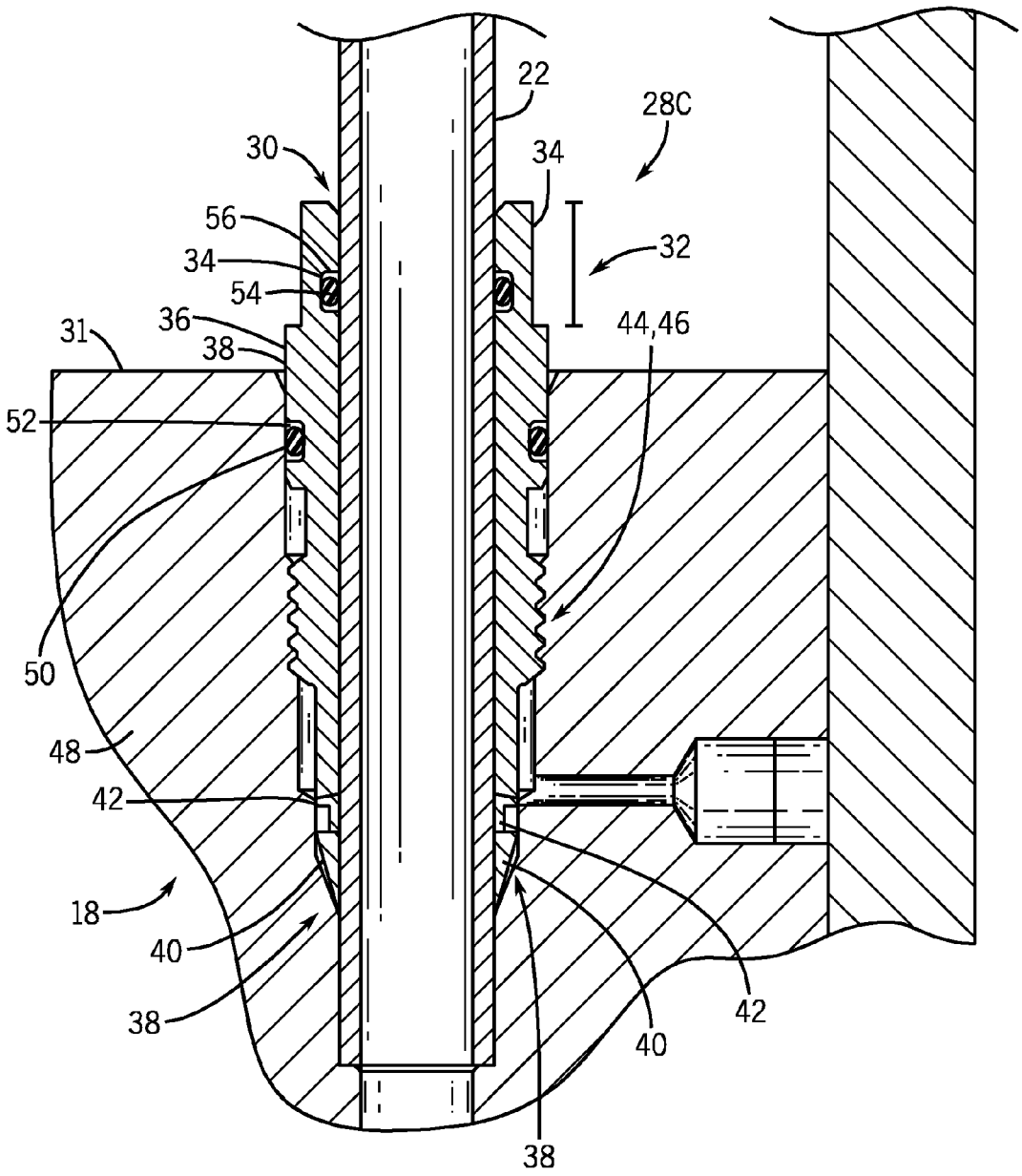
FIG. 3 is a view of Section 3-3 taken in FIG. 2.

FIG. 3 shows a view of Section 3-3 taken through fitting 28*c* in FIG. 2. Each fitting 28*a*-28*e* extends axially into the packer 18 and creates a seal between the packer 18 and the respective control line 22. A compression nut 36 seats on a ferrule 38, which includes a front portion 40 and a back portion 42. Compression nut 36 has helical grooves 44 on its outer surface for rotatably mating with helical grooves 46 on an inner portion 48 of the packer 18. An O-ring seal 50 is provided in a groove 52 and seals the outer surface 38 of the compression nut 36 to the inner portion 48 of the packer 18. Another O-ring seal 54 is provided in a groove 56 and seals the inner surface of the compression nut 36 to the control line 22 when the fitting 28*a*-28*e* is secured to the packer 18.

During installation, the control line 22 is fed through the inner portion 48 of the packer 18 and then a fitting 28*a*-28*e* is fed onto the control line 22. The fitting 28*a*-28*e* is coupled to the packer 18, which in turn seals control line 22 in a fluid-tight manner with the inner portion 48 of the packer 18. Specifically, rotating the fitting 28*a*-28*e* in one direction relative to the inner portion 48 causes the threaded engagement 44, 46 to facilitate relative movement of the fitting 28*a*-28*e* into the inner portion 48 of the packer 18. As the fitting 28*a*-28*e* moves into the inner portion 48, ferrule 38 and O-ring seal 54 seal to the outer surface of control line 22. Rotating the fitting 28*a*-28*e* in the other direction relative to the inner portion 48 causes the threaded engagement 44, 46 to facilitate relative movement of the fitting 28*a*-28*e* out of the inner portion 48.

Figure 4:
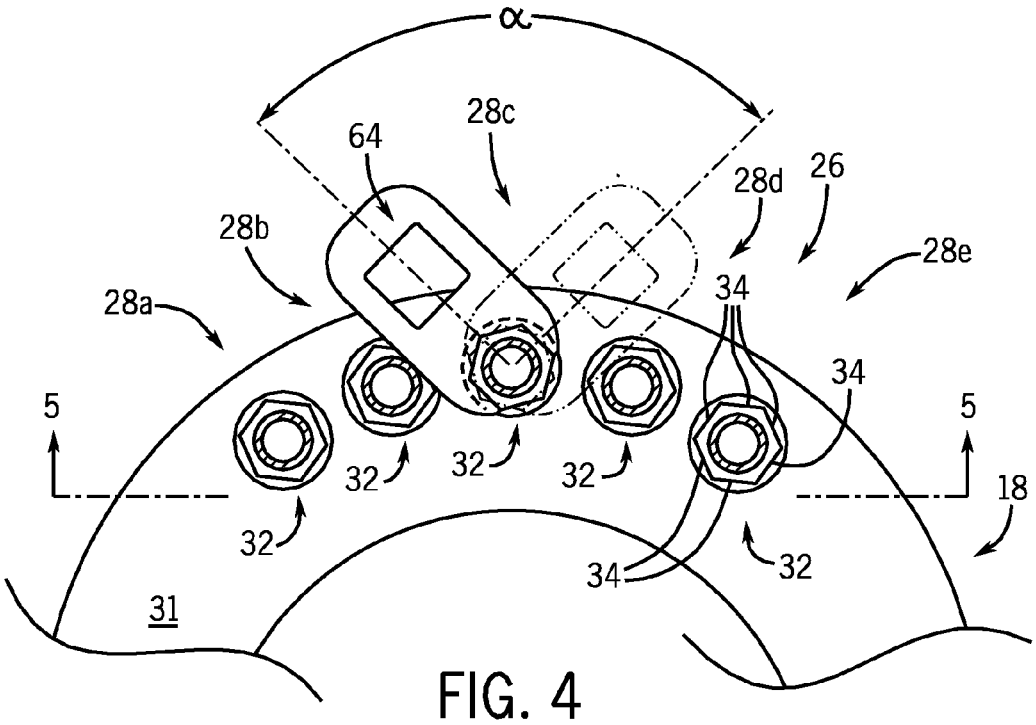
FIG. 4 is a partial top view of an exemplary fitting arrangement according to the present application.
Figure 5:
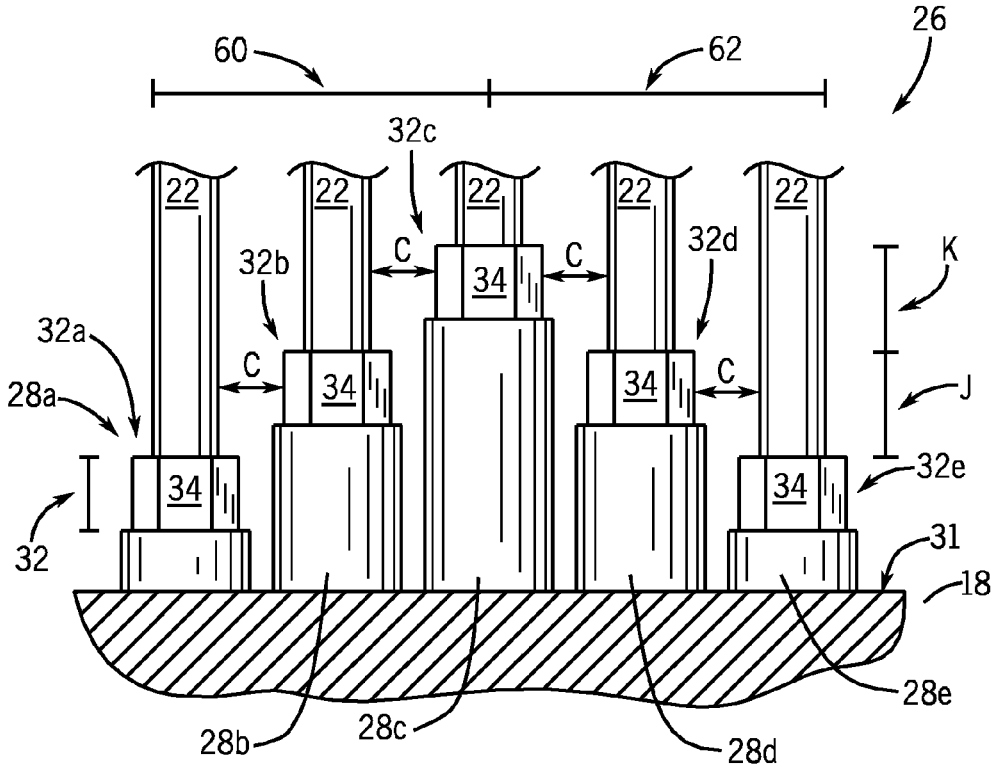
FIG. 5 is a view of Section 5-5 taken in FIG. 4.

As shown in FIGS. 4 and 5, the engagement portions 32 are located on the distal end 34 of the respective fitting 28*a*-28*e* in the axial direction. The engagement portions 32 in adjacent fittings are offset relative to each other in the axial direction. Specifically, engagement portion 32*a* is axially offset from engagement portion 32*b* by a distance J; engagement portion 32*b* is axially offset from engagement portion 32*c* by a distance K; engagement portion 32*c* is axially offset from engagement portion 32*d* by the distance K; and engagement portion 32*d* is axially offset from engagement portion 32*e* by the distance J. Preferably, the distances J and/or K are equal to or greater than the height of the respective engagement portion 32 in the axial direction. In the example of FIG. 5, the aligned fittings 28*a*-28*e* and the respective engagement portions 32 together form an ascending tier 60 and a descending tier 62.

An installation tool 64 engages a plurality of the engagement surfaces 34 to rotate the respective fittings 28*a*-28*e* during installation. It will be recognized that the installation tool 64 can be any one of a number of installation tools used in the art including, but not limited to wrenches, drivers, welding machines, and the like. In the embodiment shown, the installation tool 64 is a wrench configured to engage four of the engagement surfaces 34. Rotation of the installation tool 64 about arc γ causes rotation of the fitting 28*c* and thereby facilitates engagement or disengagement of the fitting 28*c* and the mounting surface 19, as described above. Importantly, the axially offset spacing of the adjacent engagement portions 32 in the fitting arrangement 26 provides a larger clearance C for insertion and rotation of the installation tool 64. Specifically, the larger clearance C allows for a larger arc of rotation γ of the installation tool 64 compared to the arc of rotation θ facilitated by the prior art. In the example shown, the installation tool 64 travels through an arc γ that is greater than 60 degrees to facilitate engagement of a new engagement surface 34 when the installation tool 64 is released and reconnected to the engagement portion 32.

In a preferred method of installation, the outermost fittings 28*a* and 28*e* are installed first. The second outermost fittings 28*b* and 28*d* are then installed next to the outside fittings. This pattern of installation is continued. Each subsequent set of fittings has a height that is offset from the previously installed fitting and facilitates clearance of the installation tool 64, as discussed above. If there are an odd number of fittings in the configuration, the middle fitting will be the tallest and installed last. If however the fitting configuration has an even number of fittings, the middle two fittings will have to be of different heights so that the last fitting installed will have an engagement portion 32 that is offset from the other middle fitting.

Figure 6:
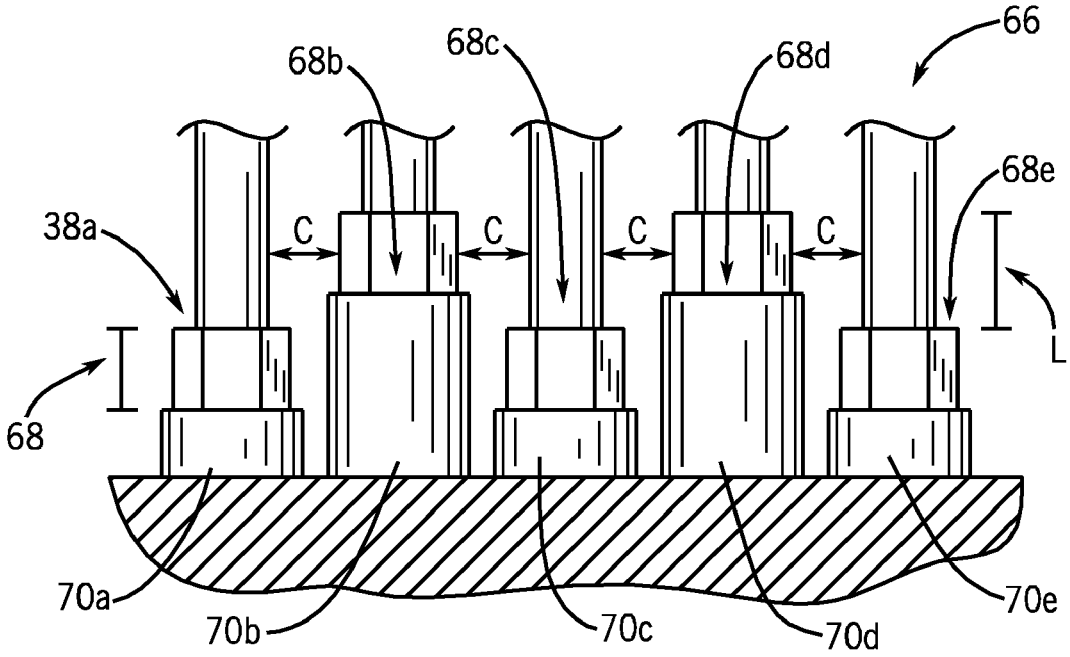
FIG. 6 is a view of another exemplary fitting arrangement according to the present application.

FIG. 6 depicts another fitting arrangement 66. Here, the respective engagement portions 68 of the fittings 70*a*-70*e* are also each located on the distal end of the respective fitting 70*a*-70*e* and are axially offset relative to each other by a distance L. Specifically, engagement portion 68*a* is offset from engagement portion 68*b*; engagement portion 68*b* is offset from engagement portion 68*c*; engagement portion 68*c* is offset from engagement portion 68*d*; and engagement portion 68*d* is offset from engagement portion 68*e*. Preferably, the distance L is greater than or equal to the height of the respective engagement portion 32 in the axial direction. The aligned fittings 70*a*-70*e* and the respective engagement portions 68 form a pattern wherein adjacent engagement portions 68 are offset relative to each other. However the aligned fittings 70*a*-70*e* consist of two different sizes of fittings to create a pattern of fitting placement and installation that can be repeated for an infinite number of fittings in a configuration.

During installation the shorter fittings 70*a*, 70*c*, 70*e* are installed first leaving one fitting hole in between each set of fittings. The longer fittings 70*b* and 70*d* are then installed in the empty fitting holes and then installed. Each row does not have to be installed all at once. For instance, two short fittings can be consecutively installed leaving an open fitting hole in between and then install a longer fitting in between the two smaller fittings. This installation method can be repeated for the length of the configuration.

What is claimed is:

1. A fitting arrangement for installation in a well bore, the fitting arrangement comprising:

a plurality of fittings coupled to and extending axially from a mounting surface of a packer in the well bore, wherein each of the fittings are configured to create a seal between a control line and the mounting surface; and an engagement surface on each of the fittings, the engagement surface configured to engage with an installation tool for coupling the fitting to the mounting surface;

the engagement surface of adjacent fittings in the plurality being axially offset from each other to thereby define an access clearance for the installation tool.

2. The arrangement of claim 1, wherein the fittings in the plurality form an array.

3. The arrangement of claim 2, wherein the array comprises first, second and third fittings, the first fitting being adjacent to the second fitting and the second fitting being adjacent to the third fitting, and wherein the engagement surface of the first fitting is axially offset from the engagement surface of the second fitting and wherein the engagement surface of the second fitting is axially offset from the engagement surface of the third fitting.

4. The arrangement of claim 3, wherein the engagement surfaces of the first and third fitting are axially offset the same distance away from engagement surface of the second fitting.

5. The arrangement of claim 3, wherein the engagement surface of the first fitting is offset a distance from the engagement surface of the second fitting, and wherein the engagement surface of the third fitting is offset a different distance from the engagement surface of the second fitting.

6. The arrangement of claim 5, wherein the array is tiered.

7. The arrangement of claim 2, wherein the engagement surface is at the distal end of the fitting relative to the mounting surface.

8. The arrangement of claim 1, wherein the engagement surface comprises a plurality of surfaces.

9. The arrangement of claim 8, wherein the plurality of surfaces comprises six surfaces aligned in series and extending 360 degrees around the outer circumference of the fitting.

10. The arrangement of claim 9, wherein the engagement surfaces are axially offset such that an installation tool configured to engage at least four surfaces in the series can rotate through an arc of rotation about the outer circumference of the fitting, the arc being greater than 60 degrees.

11. A fitting arrangement for installation in a well bore, the fitting arrangement comprising:

a packer disposed in the well bore;

a plurality of fittings coupled to and extending axially from a surface of the packer, each of the fittings defining a passageway into the packer;

a control line extending into each of the fittings;

an engagement surface on each fitting, the engagement surface configured to engage with an installation tool for coupling the fitting to the packer;

the engagement surface of adjacent fittings in the plurality being axially offset from each other to thereby define an access clearance for the installation tool.

12. The arrangement of claim 11, wherein the fittings in the plurality form an array.

13. The arrangement of claim 12, wherein the array comprises first, second and third fittings, the first fitting being adjacent to the second fitting and the second fitting being adjacent to the third fitting, and wherein the engagement surface of the first fitting is axially offset from the engagement surface of the second fitting and wherein the engagement surface of the second fitting is axially offset from the engagement surface of the third fitting.

14. The arrangement of claim 13, wherein the engagement surfaces of the first fitting and third fitting are axially offset the same distance away from the planar surface.

15. The arrangement of claim 13, wherein the engagement surface of the first fitting is offset a distance from the engagement surface of the second fitting, and wherein the engagement surface of the third fitting is offset a different distance from the engagement surface of the second fitting.

16. The arrangement of claim 15, wherein the array is tiered.

17. The arrangement of claim 11, wherein the engagement surfaces are at the distal ends of the fittings relative to the surface of the packer.

18. The arrangement of claim 11, wherein the engagement surface comprises a plurality of surfaces.

19. The arrangement of claim 18, wherein the plurality of surfaces comprises six surfaces aligned in series and extending 360 degrees around the outer circumference of the fitting.

20. The arrangement of claim 18, wherein the engagement surfaces are axially offset such that an installation tool configured to engage at least four surfaces in the series can rotate through an arc of rotation about the outer circumference of the fitting, the arc being greater than 60 degrees.

21. A method of securing a fitting arrangement to a packer in a well bore, the method comprising the steps of:

providing a packer configured to seal with a well tubing string;

providing a plurality of axially elongated fittings, each of the fittings having engagement surfaces for engaging with an installation tool;

coupling each of the fittings to adjacent locations on mounting surface of the packer by engaging the respective engagement surfaces with an installation tool, wherein when the fittings are coupled to the packer, the engagement surfaces of adjacent fittings in the plurality are offset from each other in the axial direction to define an access clearance for an installation tool;

threading a control line through each of the plurality of fittings; and inserting the well tubing string, packer and plurality of fittings into the well bore.

22. The method of claim 21, wherein the engagement surfaces of the adjacent fittings in the plurality comprise six surfaces aligned in series and extending 360 degrees around the outer circumference of the fitting, wherein the fittings are coupled to adjacent locations on the mounting surface by engaging at least four of the six surfaces in the plurality with a corresponding engagement tool and rotating the tool through an arc of rotation about the outer circumference of the fitting, the arc of rotation being greater than 60 degrees.

23. The method of claim 21, comprising the steps of:

securing a first fitting to the packer by engaging the engagement surface of the first packer with an installation tool; and securing a second fitting to the packer by engaging the engagement surface of the second fitting with an installation tool, the engagement of the second fitting being offset relative to the engagement surface of the first packer when the first and second fittings are secured to the packer.

24. The method of claim 21, comprising the steps of:

securing a first fitting to the packer by engaging the engagement surface of the first packer with an installation tool;

securing a second fitting to the packer by engaging the engagement surface of the second fitting with an installation tool; and securing a third fitting to the packer by engaging the engagement surface of the third fitting with an installation tool, the third fitting being located in between the first and second fittings, wherein the engagement surface of the third fitting is offset from the engagement surfaces of the first and second fittings.

25. The method of claim 24, wherein the engagement surfaces of the first and second fittings are not offset relative to each other.

* * * * *